US005823664A

United States Patent [19]

Demshki, Jr. et al.

[11] Patent Number: 5,823,664

[45] Date of Patent: Oct. 20, 1998

[54] RECESSED LIGHTING FIXTURE

[75] Inventors: Robert J. Demshki, Jr., Riner; Gerry F. Thornton, Christiansburg, both of Va.

[73] Assignee: Hubbell Incorporated, Orange, Conn.

[21] Appl. No.: 654,692

[22] Filed: May 29, 1996

[51] Int. Cl.[6] ..... F21S 1/06

[52] U.S. Cl. ..... 362/366; 362/147; 362/287; 362/427; 362/348

[58] Field of Search ..... 362/366, 148, 362/365, 147, 287, 427, 304, 350, 347, 348

[56] References Cited

U.S. PATENT DOCUMENTS

| | | | |
|---|---|---|---|
| D. 94,387 | 1/1935 | Kolodzey . | |
| D. 194,405 | 1/1963 | Rodriguez et al. | D48/31 |
| D. 326,536 | 5/1992 | Gattari | D26/74 |
| 2,716,185 | 8/1955 | Burliuk et al. | 240/78 |
| 2,826,684 | 3/1958 | Baker | 240/78 |
| 2,859,333 | 11/1958 | Burliuk et al. | 362/366 |
| 3,182,187 | 5/1965 | Gellert | 240/78 |
| 3,361,904 | 1/1968 | Docimo | 240/78 |
| 3,381,123 | 4/1968 | Docimo | 240/78 |
| 3,660,651 | 5/1972 | Miles, Jr. | 240/73 BJ |
| 3,700,885 | 10/1972 | Bobrick | 240/78 |
| 4,673,149 | 6/1987 | Grote et al. | 248/343 |
| 4,712,168 | 12/1987 | Scherrer | 362/427 |
| 4,729,080 | 3/1988 | Fremont et al. | 362/366 |
| 4,733,339 | 3/1988 | Kelsall | 362/366 |
| 4,829,410 | 5/1989 | Patel | 362/147 |
| 5,075,831 | 12/1991 | Stringer et al. | 362/365 |
| 5,124,901 | 6/1992 | Sojika et al. | 362/366 |
| 5,373,431 | 12/1994 | Hayman et al. | 362/364 |
| 5,452,193 | 9/1995 | Hinnefeld et al. | 362/366 |
| 5,457,617 | 10/1995 | Chan et al. | 362/366 |
| 5,548,499 | 8/1996 | Zadeh | 362/366 |

*Primary Examiner*—James C. Yeung
*Attorney, Agent, or Firm*—Jerry M. Presson; David L. Tarnoff; Thomas P. Hilliard

[57] ABSTRACT

A recessed lighting fixture or downlight is disclosed for mounting in a wide range of sloped ceilings. The recessed lighting fixture has a lamp adjustably coupled to a housing via an adjustable socket assembly having three degrees of movement for aiming the lamp in a particular direction, preferably perpendicular to the floor. The adjustable socket assembly has an upstanding bracket and a socket strap for aiming the lamp. In particular, the upstanding bracket has one end pivotally coupled to the trim collar of the housing for rotational movement of the lamp about a first pivot axis, and its other end pivotally coupled to the socket strap for rotational movement of the lamp about a second pivot axis. Also, the bracket and socket strap are coupled for linear movement of the lamp relative to the housing. In a preferred embodiment, the lighting fixture is provided with a reflector having baffles such that the lighting fixture has substantially the same appearance regardless of the slope of the ceiling.

29 Claims, 10 Drawing Sheets

FIG. 7
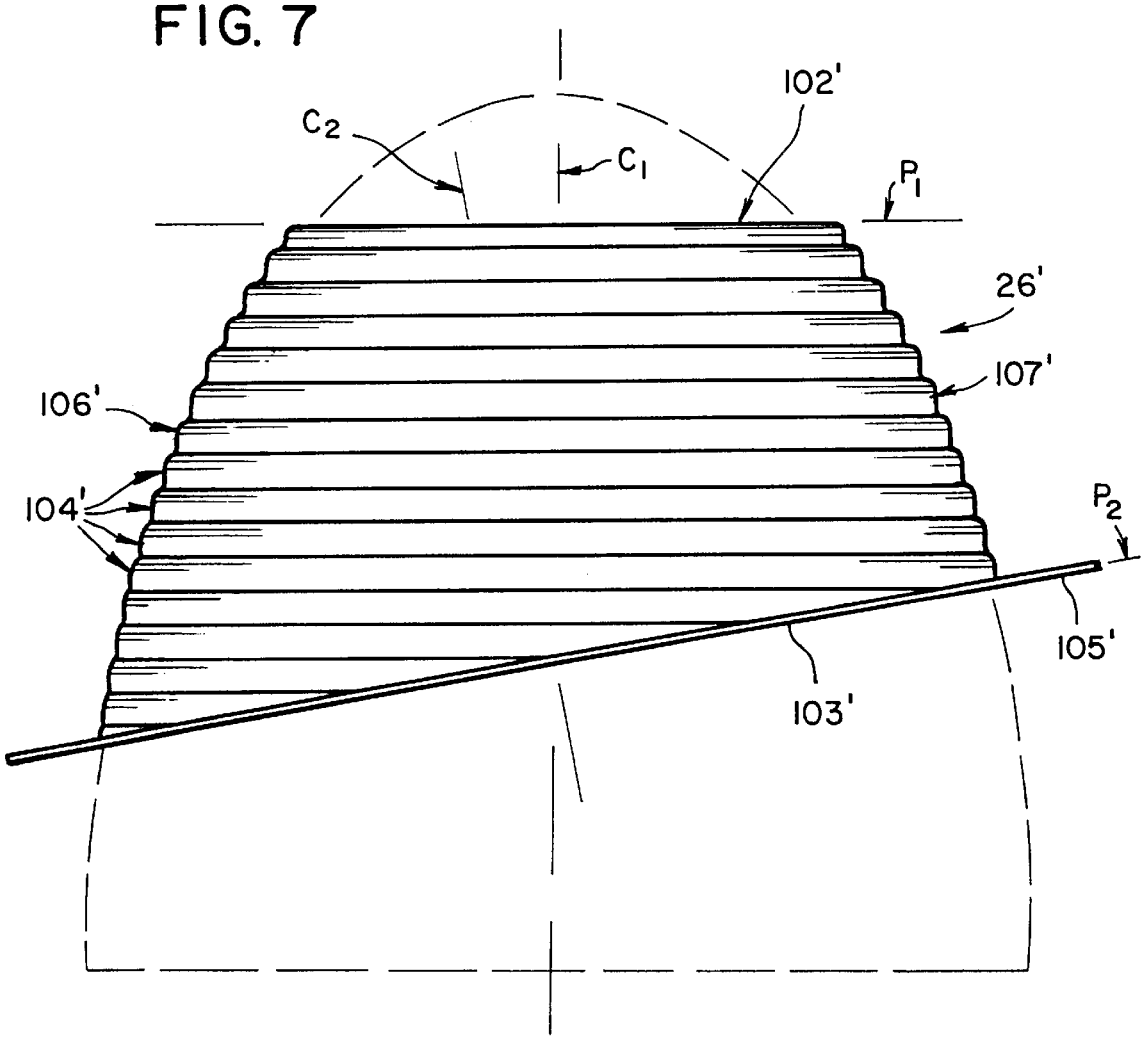
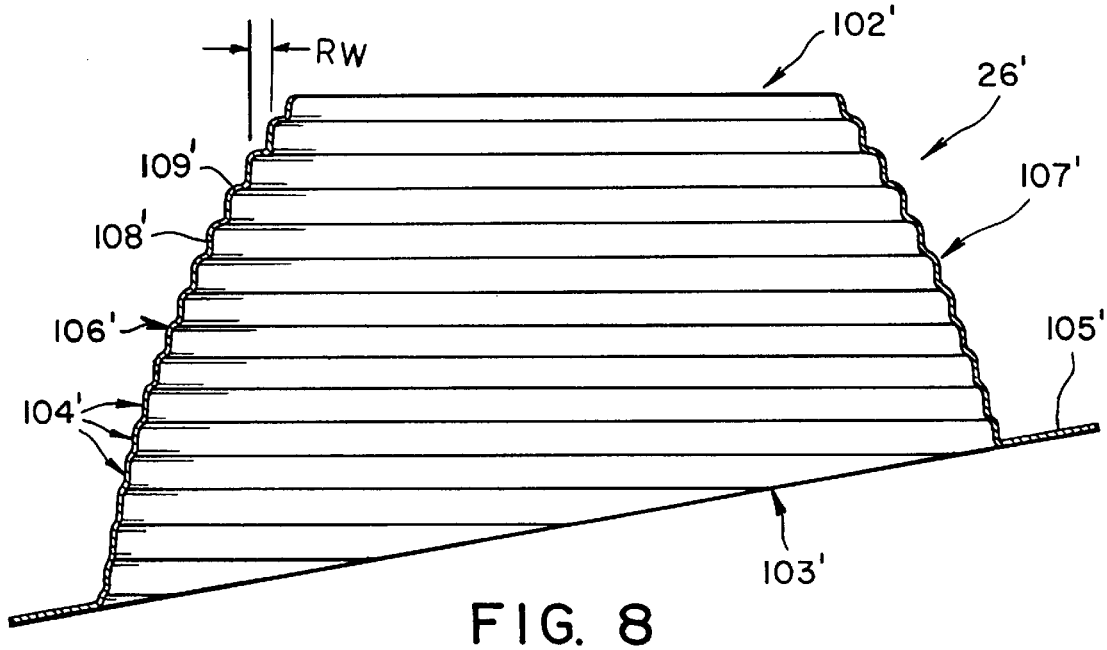
FIG. 8

RECESSED LIGHTING FIXTURE

FIELD OF THE INVENTION

The present invention generally relates to a recessed lighting fixture which is designed to be installed in a sloped ceiling. More specifically, the present invention relates to a recessed lighting fixture which can be installed in a wide range of sloped ceilings. The recessed lighting fixture has an adjustable socket assembly for aiming the lamp and a cone-shaped reflector with baffles. The adjustable socket assembly has three degrees of movement for aiming the lamp in a particular direction, preferably perpendicular to the floor.

BACKGROUND OF THE INVENTION

Recessed lighting fixtures or downlights have become increasingly popular in today's homes and businesses. One reason for the increased use of recessed lighting fixtures or downlights is that they can met a wide range of interior lighting requirements since they are not only functional, but also aesthetically pleasing. Currently, there are many manufacturers of recessed lighting fixtures and numerous designs available for mounting recessed lighting fixtures in a ceiling. Typically, these recessed lighting fixtures vary in design and configuration depending upon the type of installation, i.e., whether they are installed in new construction, in existing ceilings or in sloped ceilings.

In most applications, it is typically desirable to have the lamp of a recessed lighting fixture arranged substantially perpendicular to the floor, whether it is installed in a horizontal ceiling or a sloped ceiling. Accordingly, the most common recessed lighting fixtures are typically constructed for a particular ceiling slope so that the lamp is arranged substantially perpendicular to the floor. However, manufacturers have more recently developed many different types of recessed lighting fixtures to accommodate various ceiling slopes.

Most designs for recessed lighting fixtures have included a sheet metal plaster plate or mounting frame with a lighting fixture receiving opening and a housing mounted to the plaster plate. Conventional recessed lighting fixtures for a sloped ceiling usually employ a circular can or box-type housing which typically has an elliptical opening for the lamp. Conventional recess lighting fixtures for a horizontal ceiling, on the other hand, usually employ a circular can or box-type housing which typically has a circular opening for the lamp. Accordingly, the appearance of the recessed lighting fixture depends upon the slope of the ceiling.

Recently, interior designers and other installers have desired a congruence of looks throughout the entire building or installation. In other words, designers and installers often desire all recessed lighting fixtures to have the same appearance in a building or installation regardless of whether the recessed lighting fixtures are installed into horizontal ceilings or sloped ceilings. Accordingly, lighting manufacturers have been requested by the interior designers and installers to create products that provide a congruence of looks for practically any ceiling slope. The need for a congruence of looks in recessed lighting installations has required lighting manufacturers to develop many new recessed lighting fixtures in an attempt to meet those demands.

For example, most of the sloped recessed lighting fixtures currently available on the market have been developed for a particular range of degrees of slope of the ceiling, and then have the ability to be adjusted for aiming the light source perpendicular to the interior floor. However, such designs often have limited flexibility to adjust the light source perpendicular to the floor, since the degree of slope of the ceiling creates a need to select a particular framing kit. The most popular slopes for sloped ceilings range from about 9° (2/12 slope) up to 45° (12/12 slope). Most conventional recessed lighting fixtures are commonly adjustable for only about 18° of slope. Thus, most manufacturers commonly produce at least two plaster frame/trim combinations to accommodate the full range of slopes for ceiling installations, i.e., a first plaster frame/trim combination which covers the range of 9 degrees to 27° (2/12 slope to 6/12 slope) and a second plaster frame/trim combination for ceilings having a slope of 30° to 45° (7/12 slope to 12/12 slope).

Examples of various recessed lighting fixtures known in the prior art are disclosed in U.S. Pat. Nos.: 2,716,185 to Burliuk et al; 2,826,684 to Baker; 3,182,187 to Gellert; 3,361,904 to Docimo; 3,381,123 to Docimo; 4,673,149 to Grote et al.; 4,712,168 to Scherrer; 4,729,080 to Fremont et al.; 4,733,339 to Kelsall; 5,075,831 to Stringer et al.; and 5,457,617 to Chan et al.

In view of the above, it is apparent that there exists a need for a recessed lighting fixture which can be installed in a wide range of sloped ceilings as well as being inexpensive to manufacture and easy to install. Accordingly, this invention addresses these needs in the art along with other needs which will become apparent to those skilled in the art once given this disclosure.

SUMMARY OF THE INVENTION

One object of the present invention is to provide a recessed lighting fixture which is adjustable for a wide range of sloped ceilings.

Another object of the present invention is to provide a recessed lighting fixture having three degrees of movement for aiming the lamp substantially perpendicular to the floor.

A further object of the present invention is to provide a recessed lighting fixture which is relatively inexpensive and simple to manufacture as well as easy to install.

A further object of the present invention is to provide a reflector with baffles that appears to provide the same appearance in ceilings of different slopes.

Yet another object of the present invention is to provide a reflector for a recessed lighting fixture which is relatively inexpensive and simple to manufacture as well as easy to install.

Still a further object of the present invention is to provide a reflector for a recessed lighting fixture having baffles and an integral trim flange.

The foregoing objects can basically be attained by providing a recessed lighting fixture for installation in a ceiling, comprising: a housing for attachment to a ceiling structure; a reflector attached to the housing, the reflector having an upper opening end and a lower open end; an adjustable socket assembly movably coupled to the housing for three degrees of movement, the socket assembly including an upstanding bracket and a socket strap forming first and second pivot joints with the first and second pivot joints being movably coupled to move towards and away from each other, the bracket being pivotally coupled to the housing adjacent a first end of the bracket via said first pivot joint, and the socket strap being pivotally coupled to a second end of the bracket via the second pivot joint; and a lamp socket coupled to the socket bracket for positioning a lamp within the reflector.

The foregoing objects can further be attained by providing an adjustable socket assembly for attachment to a housing of a recessed lighting fixture, comprising: an upstanding bracket having a first end with a first aperture, and a second end with a second aperture; a socket strap having a third aperture for coupling the bracket thereto, and an opening for coupling a lamp socket thereto; a first fastener positioned in the first aperture of the bracket to form a first pivot joint for pivotally coupling the first end of the bracket to the housing of the recessed lighting fixture; and a second fastener positioned in the second aperture of the bracket and the third aperture of the socket strap to form a second pivot joint to pivotally couple the second end of the bracket to the socket strap, one of the apertures being an elongated slot to adjust the distance between first and second pivot joints.

The foregoing objects can also be attained by providing a reflector for a recessed lighting fixture, comprising: an open upper end lying in a first plane; an open lower end lying in a second plane which is non-parallel to the first plane; and a side wall extending between the open upper and lower ends, the side wall including a plurality of annular baffles being angled to the second plane of the open lower end, each of the baffles having a tubular section with a center line extending perpendicular to the first plane and an inwardly extending ring-shaped section, each of the tubular sections being concentric, and the ring-shaped sections being larger at the upper end and gradually smaller as they approach the lower end.

Other objects, advantages and salient features of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the drawings which form part of this original disclosure:

FIG. 7 is a side elevational view illustrating a preferred one-piece, sloped ceiling reflector with baffles in accordance with the present invention which is adapted to be mounted within a recessed lighting fixture illustrated in FIG. 1;

FIG. 8 is a longitudinal cross-sectional view of the reflector with baffles illustrated in FIG. 7;

DETAILED DESCRIPTION OF THE PREFERRED EMBODIMENTS

Figure 1:
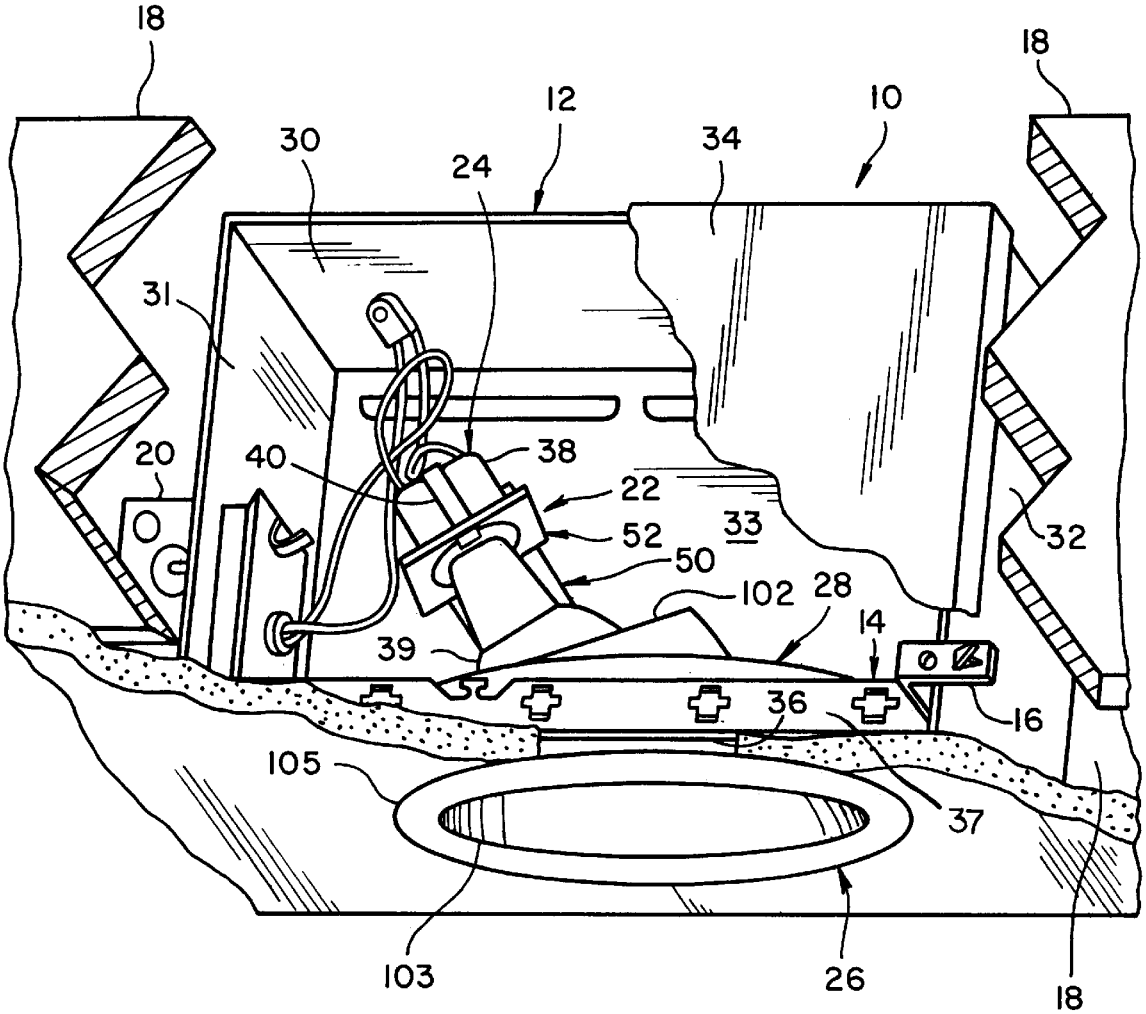
FIG. 1 is a perspective view of a recessed lighting fixture in accordance with the present invention, which has been installed in a sloped ceiling and which has certain parts broken away for purposes of illustration.
Figure 2:
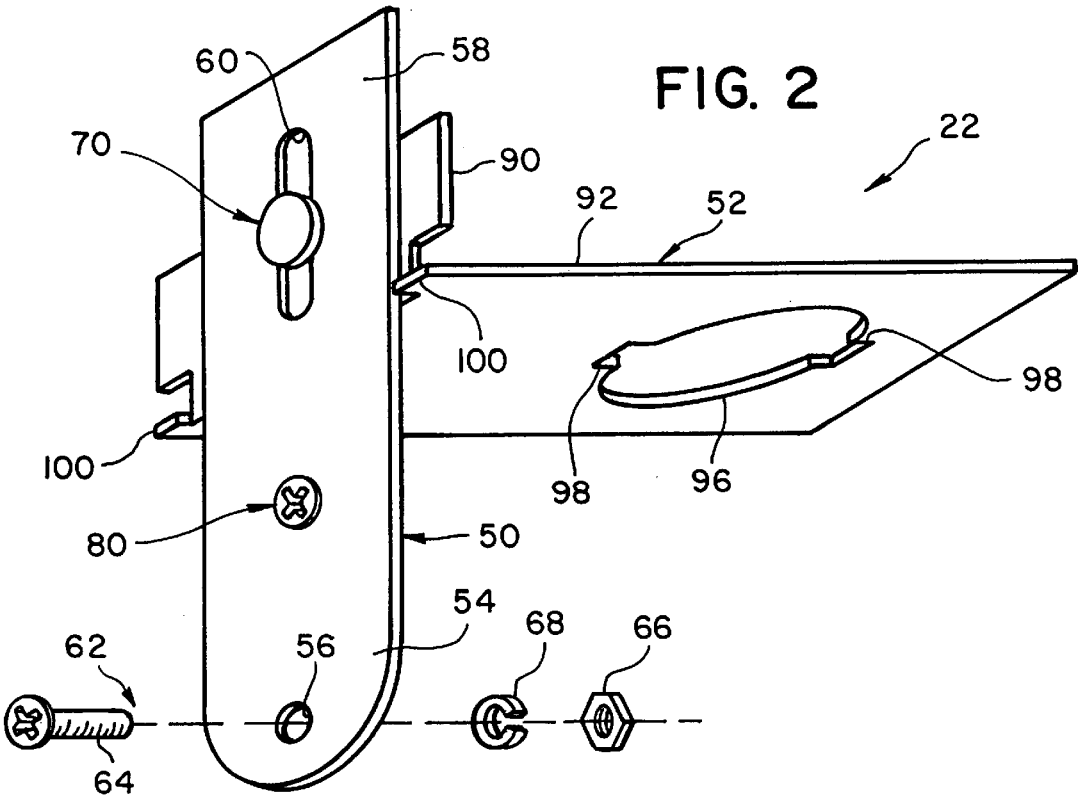
FIG. 2 is a perspective view of the adjustable socket assembly illustrated in FIG. 1, prior to being attached to the housing.

Initially referring to FIGS. 1 and 2, a recessed lighting fixture 10 in accordance with the present invention is illustrated. Recessed lighting fixture 10 includes a lamp housing 12 with a plaster plate or mounting frame 14 releasably coupled thereto and a pair of adjustable bar hangers 16 (only one shown) coupled to plaster plate 14 for rigidly coupling lighting fixture 10 between a pair of joist or support members 18. Recessed lighting fixture 10 further includes a junction box 20 fixedly coupled to plaster plate 14, an adjustable socket assembly 22 for adjustably aiming a lamp assembly 24 mounted thereon, and a reflector 26 coupled to plaster plate 14 of housing 12 via a trim collar 28.

Lighting fixture 10 is designed to be mounted in a wide variety of sloped ceilings since adjustable socket assembly 22 allows lamp assembly 24 to be aimed to a desired location, preferably perpendicular to the floor, as discussed below in more detail. Also, reflector 26 is designed to provide a congruence of looks in a wide variety of sloped ceilings as discussed below.

As seen in FIG. 1, lamp housing 12 is preferably a conventional box type housing having a top wall 30, a pair of end walls 31 and 32 and a pair of side walls 33 and 34. Walls 31–34 depend substantially perpendicularly and downwardly from top wall 30, with end walls 31 and 32 being integrally formed with top wall 30 by fold lines. Side walls 33 and 34 are detachably coupled to walls 30–32 for accessing adjustable socket assembly 22. The walls 31–34 are attached at their lower ends to plaster plate or mounting frame 14 at their lower end via conventional fasteners (not shown). Preferably, top wall 30, end walls 31 and 32 and side walls 33 and 34 are constructed of a sheet metal material such as aluminum or galvanized steel. Lamp housing 12 is preferable sized to provide ample air space between its walls 30–34 and lamp assembly 24 to allow for safe operation of lamp assembly 24, when lamp housing 12 is in direct in contact with ceiling insulation. Since lamp housings, such as lamp housing 12, are well known in the prior art, lamp housing 12 will not be discussed or illustrated in detail herein.

Plaster plate or mounting frame 14 is preferably a generally rectangular plate having a circular or elliptical opening 36 for fixedly receiving trim collar 28 therein and a pair of side rails 37 (only one shown) for adjustably supporting a pair of bar hangers 16. Preferably, plaster plate 14 and bar hangers 16 are constructed of suitable metallic material. For example, plaster plate 14 can be stamped out of a sheet metal material such as galvanized steel or aluminum sheets. Mounting frame 14 and bar hangers 16 are conventional members which are well known in the art. For example, mounting frame 14 and bar hangers 16 can be constructed in substantially the same manner as disclosed in U.S. Pat. No. 5,075,831 to Stringer et al., the entire disclosure of which is hereby incorporated herein by reference. Thus, mounting frame 14 and bar hangers 16 will not be discussed or illustrated in detail herein.

Electrical junction box 20 is a standard electrical box which is rigidly coupled to mounting frame 14 in a conventional manner. Preferably, electrical junction box 20 is pre-wired to be electrically coupled to lamp assembly 24 in a conventional manner. In particular, electrical junction box 20 is pre-wired so that, when lighting fixture 10 is installed into the ceiling, all that the installer needs to do is to electrically couple an electrical power line to the electrical wires (not shown) in electrical junction box 20 in order to provide electrical power to lamp assembly 24. For example, see U.S. Pat. No. 5,075,831 to Stringer et al., the disclosure of which has been incorporated herein by reference.

Figure 5:
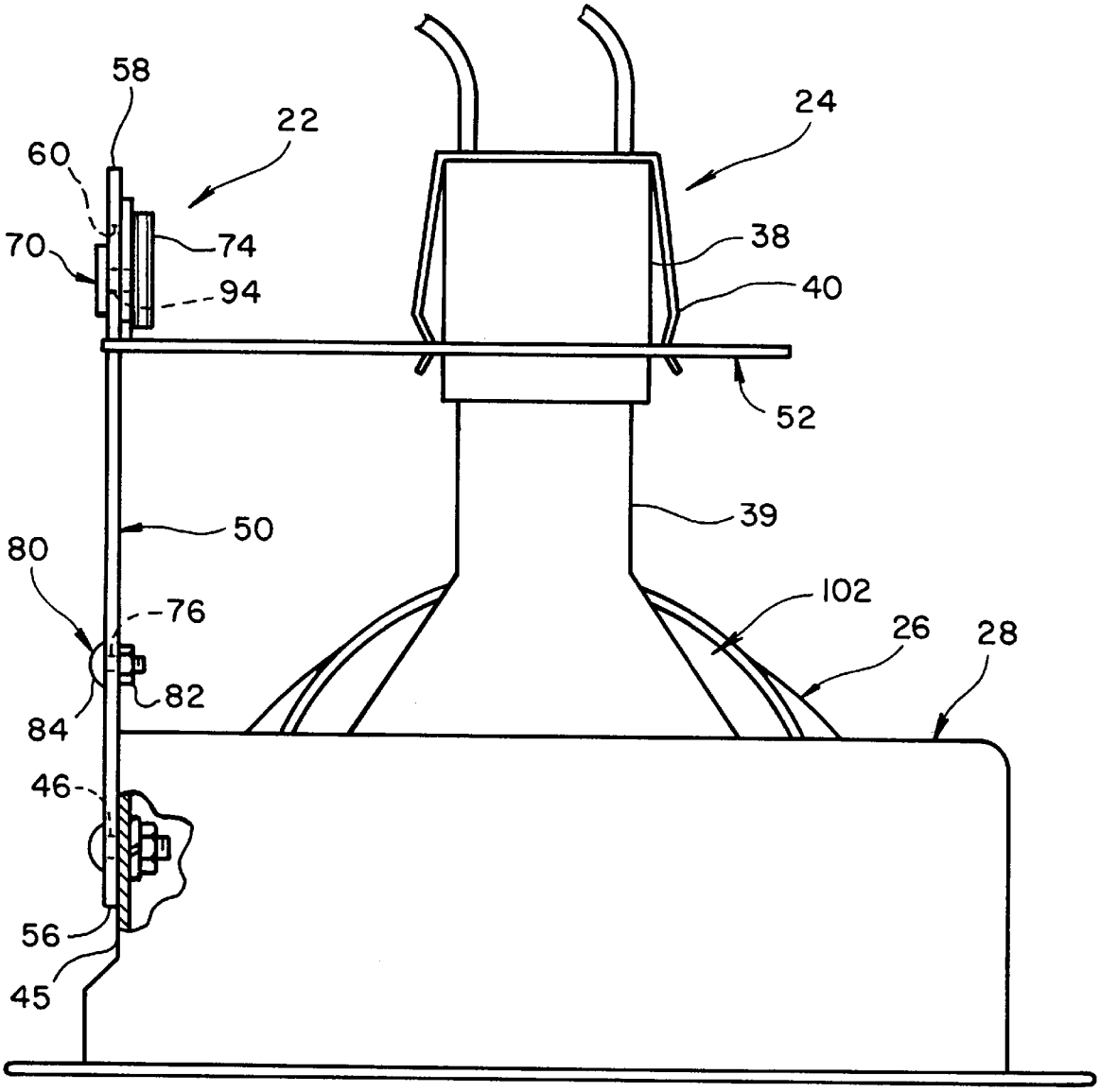
FIG. 5 is a right end elevational view of the adjustable socket assembly illustrated in FIGS. 1–4, with its bracket coupled to the trim collar of the housing for pivotally movement from the vertical position as shown to an angled position, e.g., 0° to 45° in either direction.

Referring now to FIGS. 1 and 5, lamp assembly 24 includes a conventional socket 38 electrically wired to junction box 20 and a conventional lamp 39 removably coupled within socket 38. Preferably, socket 38 is constructed from porcelain and is wired to junction box 20 in a conventional manner as mentioned above. Preferably, socket 38 is releasably coupled to adjustable socket assembly 22 via a snap fit. In particular, socket 38 is provided with a pair of spring members 40 for releasably coupling socket 38 to adjustable socket assembly 22 as discussed below. Lamp 39 is preferably threadedly mounted in socket 38 and can be either a short or long-necked lamp. Since sockets and lamps, such as socket 38 and lamp 39, are well known in the prior art, socket 38 and lamp 39 will not be discussed or illustrated in detail herein.

Figure 3:
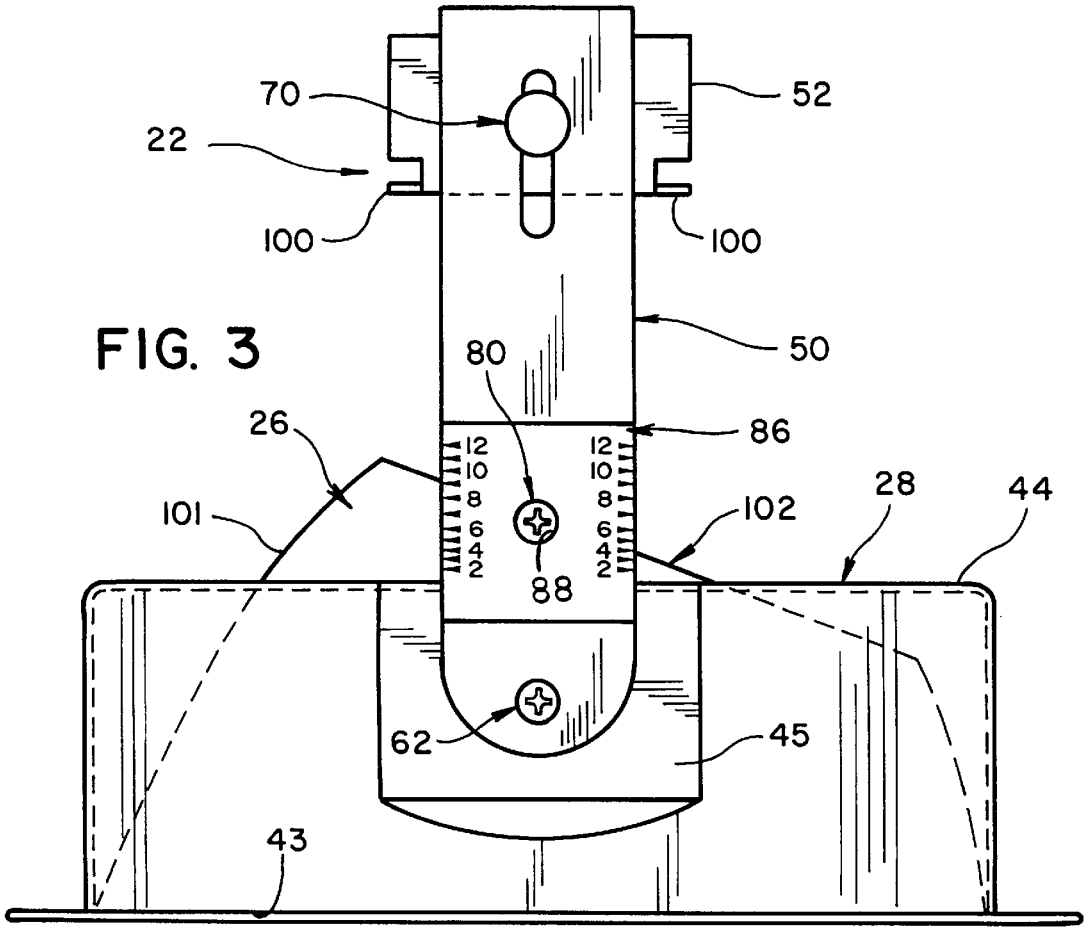
FIG. 3 is a side elevational view of the adjustable socket assembly illustrated in FIGS. 1 and 2, with its bracket coupled to the trim collar of the housing for pivotally movement from the vertical position as shown to an angled position, e.g., 0° to 45° in either direction.
Figure 4:
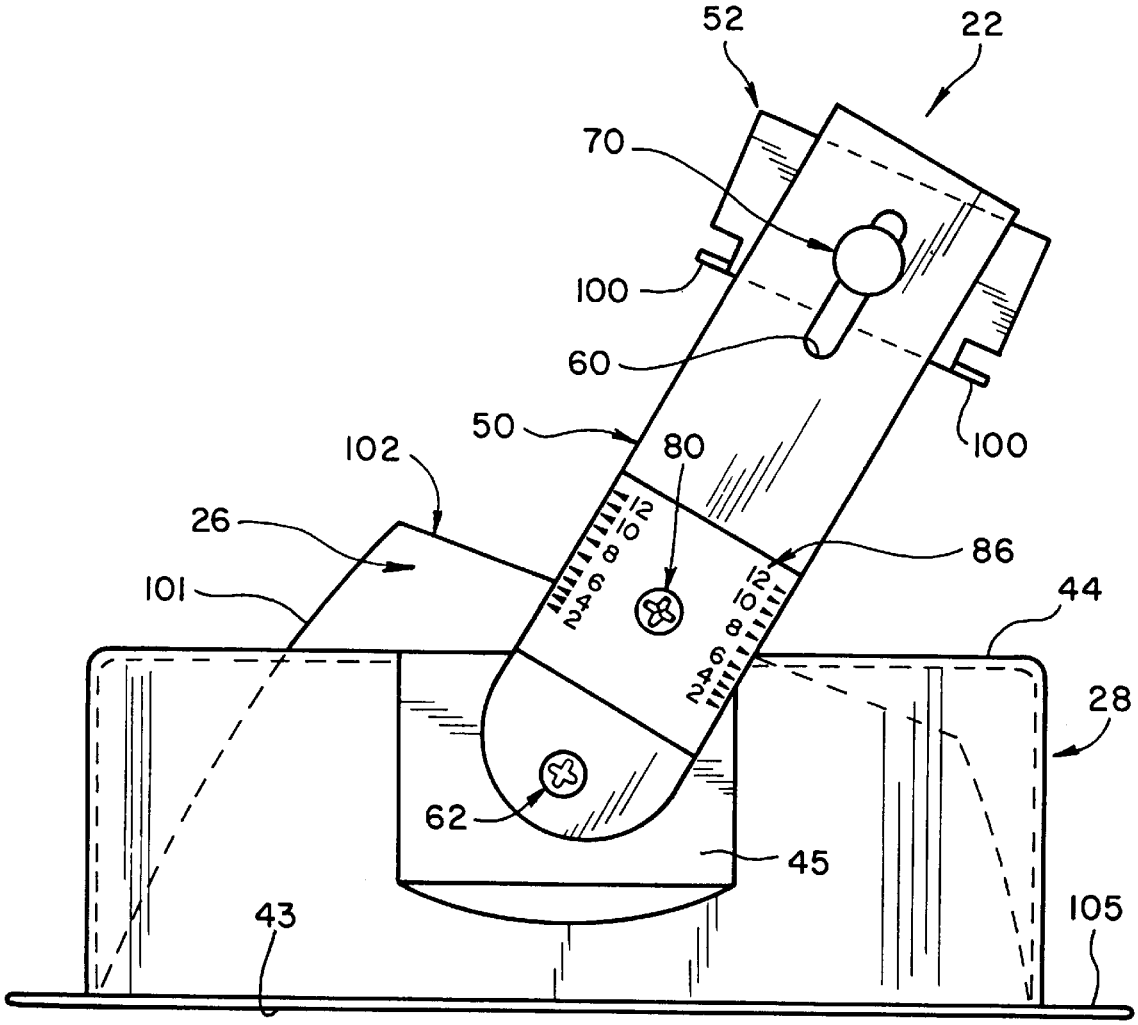
FIG. 4 is a side elevational view of the adjustable socket assembly illustrated in FIGS. 1–3, with its bracket and socket strap pivoted for a ceiling with a 30° or 7/12 slope.

As seen in FIGS. 3–5, trim collar 28 is positioned within opening 36 of plaster plate 14 and is fixedly coupled thereto in a conventional manner. For example, trim collar 28 can be coupled to plaster plate 14 by screws (not shown). Of course, trim collar 28 can be fastened to plaster plate 14 by other fastening means, such as clips, rivets, adhesives, etc. Alternatively, trim collar 28 can be integrally formed with plaster plate 14. Preferably, trim collar 28 is constructed of from a sheet metal material, such as aluminum or galvanized steel, or any other suitable metallic or non-metallic material. For the purposes of this disclosure and the claims appended thereto, plaster plate 14 and trim collar 28 are considered to be part of the structure of housing 12.

Trim collar 28 is preferably a tubular member having a substantially cylindrical or elliptical cross section, with an bottom open end 43 for fixedly receiving reflector 26 therein, and a top open end 44 for receiving lamp 39 therethrough. While reflector 26 is illustrated as being attached within trim collar 28 by adhesive, it will be apparent to those skilled in the art from this disclosure that other fastening means can be used such as a snap-fit arrangement or the like. A flat pivot section 45 with a pivot hole 46 is provided on the side wall of trim collar 28 for pivotally coupling adjustable lamp assembly 22 thereto.

Referring to FIGS. 3–5, adjustable socket assembly 22 includes an upstanding bracket 50 and a socket strap 52. Bracket 50 and socket strap 52 are preferably constructed of a sheet metal material which is stamped and/or bent to form bracket 50 and socket strap 52. For example, bracket 50 and socket strap 52 can be constructed of galvanized steel or any other suitable sheet metal material.

Bracket 50 is an elongated flat member, which has a first end 54 with a first aperture 56 and a second end 58 with a second aperture 60. Aperture 56 is preferably a circular hole which receives a first fastener 62 for pivotally coupling first end 54 of bracket 50 to trim collar 28 of lamp housing 12. More specifically, first fastener 62 extends through aperture 56 of bracket 50 and pivot hole 46 of trim collar 28 to pivotally couple bracket 50 for limited rotational movement about the longitudinal axis of fastener 62. Preferably, first fastener 62 is a threaded fastener such as bolt or screw 64 with a nut 66 and a lock washer 68. Of course, nut 66 and lock washer 50 can be replaced with a locking nut, if needed or desired. Thus, when first fastener 62 is tightened, bracket 50 will be clamped against trim collar 28 of lamp housing 12 to maintain bracket 50 in a desired angular position relative to lamp housing 12. In other words, first fastener 62 together with pivot hole 46 of trim collar 28 and aperture 56 of bracket 50 forms a first pivot joint between adjustable socket assembly 22 and housing 12 for aiming lamp 39.

Second aperture 60 of bracket 50 is preferably an elongated slot which receives a second fastener 70 for pivotally coupling second end 58 of bracket 50 to socket strap 52. Preferably, second aperture or slot 60 provides approximately 1.5 inches of vertical or longitudinal movement of socket strap 52 along the longitudinal axis of bracket 50. Second fastener 70 forms a second pivot joint between adjustable socket assembly 22 and housing 12 for aiming lamp 39 as well as adjusting the location of lamp 39 within reflector 26.

Preferably, second fastener 70 includes a shoulder rivet 72 and a stainless steel spring 74 which pivotally and slidably secures second end 58 of bracket 50 to socket strap 52 for easy adjustment without the need for tools. More specifically, second fastener 70 extends through aperture 60 of bracket 50 for both rotational and linear movement within aperture 60. Spring 74 is designed to assert a clamping force on bracket 50 and socket strap 52 for coupling them together and for maintaining their relative angular orientation therebetween. More specifically, the force of spring 74 is designed such that socket strap 52 can be easily rotated and/or moved vertically relative to bracket 50 to permit relative angular and linear adjustments therebetween without the need for tools, while maintaining lamp assembly 24 in any selected angular position once rotated or moved to a desired position.

As can be readily seen from the Figures, the first pivot joint formed by fastener 62 provides the installer with a coarse adjustment of lamp 39 via adjustable socket assembly 22, while the second pivot joint formed by fastener 70 provides the installer with a fine adjustment of lamp 39 via adjustable socket assembly 22. In other words, the installer will typically set the angle of lamp 39 for a particular slope of a ceiling by pivoting bracket 50 about the axis of fastener 62, and then tightening fastener 62 to maintain the selected angle for lamp 39. Next, the installer mounts lighting fixture 10 in the ceiling between joists 18 via bar hangers 16. Once the ceiling is finished and the reflector 26 is attached to trim collar 28, lamp 39 can be installed into socket 38 and adjusted via the second pivot joint of adjustable socket assembly 22.

As seen in FIG. 5, bracket 50 is also preferably provided with an intermediate aperture 76 for receiving a third threaded fastener 80 in the form of a nut 82 and a screw or bolt 84. Fastener 80 forms a stop member for limiting the pivotal movement of bracket 50 relative to housing 12. Specifically, fastener 80 is designed to engage the upper edge of trim collar 28 to limit the angular movement of bracket 50 relative to lamp housing 12. Preferably, fastener 80 is designed to permit bracket 50 to pivot around the longitudinal axis of first fastener 62 through an angle of approximately 90°. In other words, bracket 50 can pivot 45° in each direction from its vertical orientation, i.e., perpendicular to mounting frame 14.

As seen in FIG. 3, a label 86 can be applied to the center section of bracket 50 to aid the installer in the initial adjustment of lamp 39 for a particular sloped ceiling. Specifically, label 86 has indicia thereon for indicating rough or coarse adjustments of bracket 50 to accommodate various ceiling slopes. Specifically, label 86 has indicia along two of its vertical edges in the form of numbers ranging from two (2) through twelve (12) and arrows positioned adjacent each number. When one of the arrows is aligned with the upper edge of trim collar 28, the bracket 50 is roughly adjusted for a particular slope as indicated by the number adjacent the arrow. For example, if the arrow adjacent the number two (2) is aligned with the upper edge of trim collar 28, then bracket 50 is set for a 2/12 sloped ceiling. Likewise, if the arrow with the number seven (7) is aligned with the upper edge of the trim collar 28 by rotation of bracket 50 about first fastener 62, then bracket 50 is set for installing lighting fixture 10 into a 8/12 sloped ceiling. To ensure correct positioning of label 86 on bracket 50, label 86 has a center opening or hole 88 which is designed to be aligned with intermediate aperture 76 of bracket 50.

Socket strap 52 has a first planar portion 90 and a second planar portion 92 which extends substantially perpendicular to first portion 90. First portion 90 is provided with an aperture or hole 94 for receiving second fastener 70 therein to pivotally and slidably couple socket strap 52 to bracket 50 about the longitudinal axis of second fastener 70.

While aperture 94 is illustrated as a circular hole, it will be apparent to those skilled in the art from this disclosure that aperture 94 could be in the form of a slot and that the second aperture 60 of bracket 50 could be in the form of a circular hole to provide the longitudinal or linear adjustment of socket strap 52 along the longitudinal axis of bracket 50. Alternatively, the first pivot joint formed by first fastener 62 and pivot hole 46 and aperture 56 can be designed to provide the linear adjustment of socket strap 52 relative to housing 12 for adjusting lamp 39 in reflector 26. Still another alternative for linear adjustment of adjustable socket assembly 22 is to construct bracket 50 out of two piece which are linearly adjustable. Thus, it will be apparent to those skilled in the art from this disclosure that adjustment means for providing three degrees of movement can be accomplished in a variety of ways and using a variety of different structures.

Figure 6:
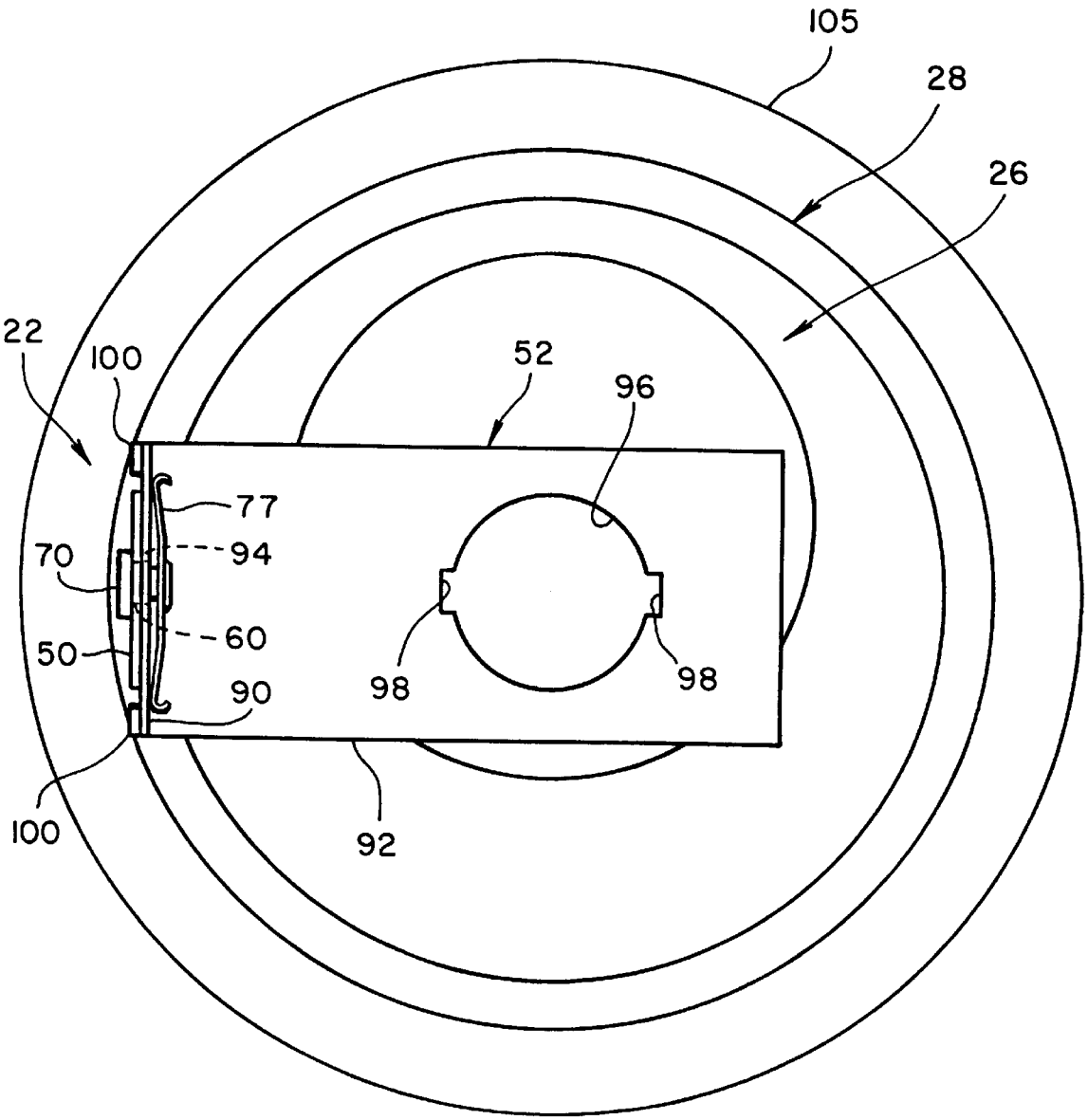
FIG. 6 is a top plan view of the adjustable socket assembly coupled to the trim collar of the housing as illustrated in FIG. 1–5.
Figure 9:
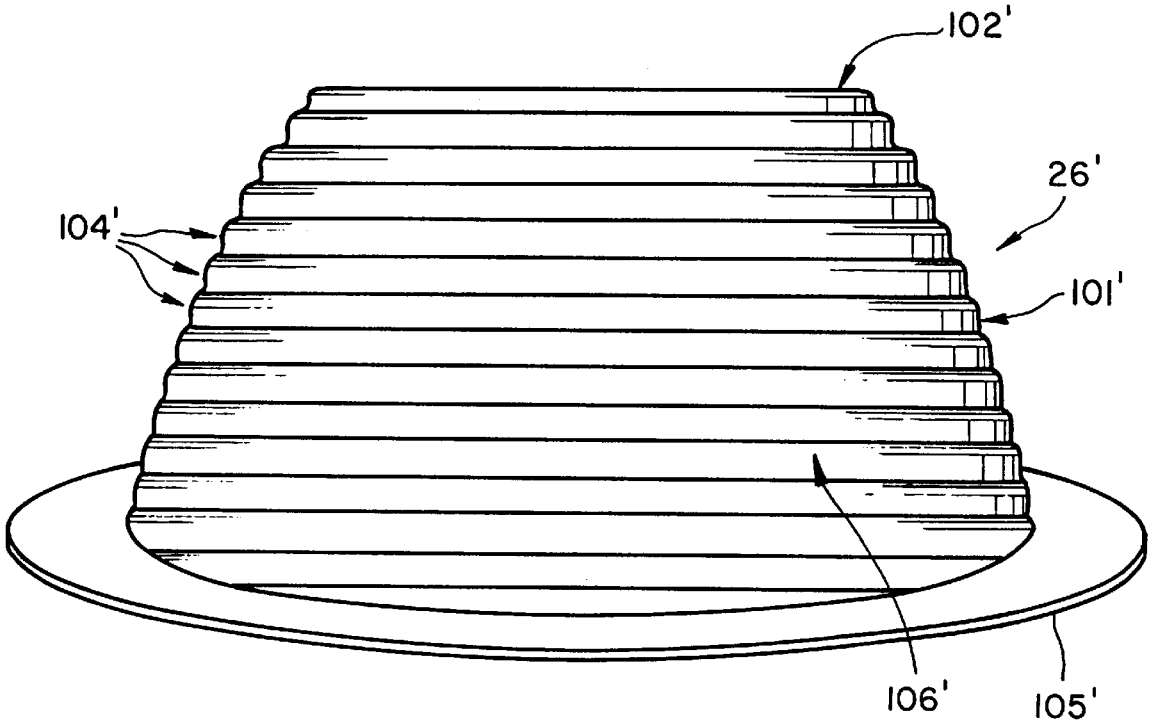
FIG. 9 is a left end elevational view of the reflector with baffles illustrated in FIGS. 7 and 8.
Figure 10:
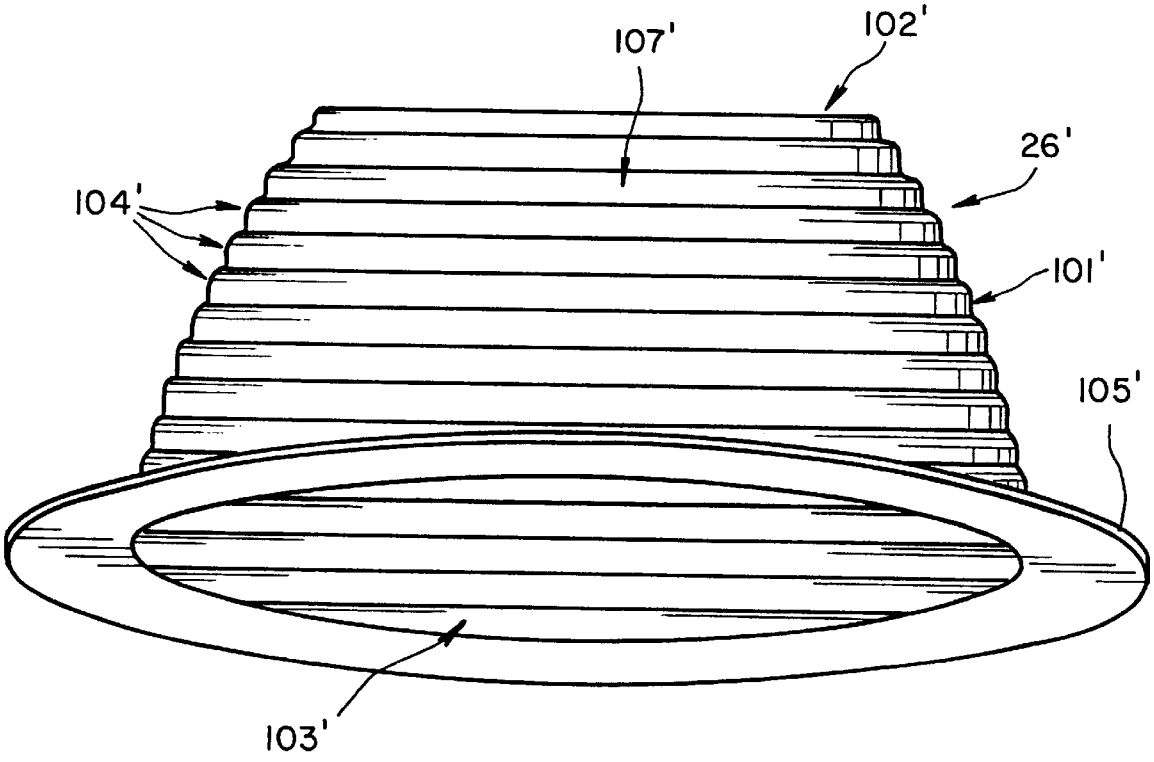
FIG. 10 is a right end elevational view of the reflector with baffles illustrated in FIGS. 7–9.
Figure 11:
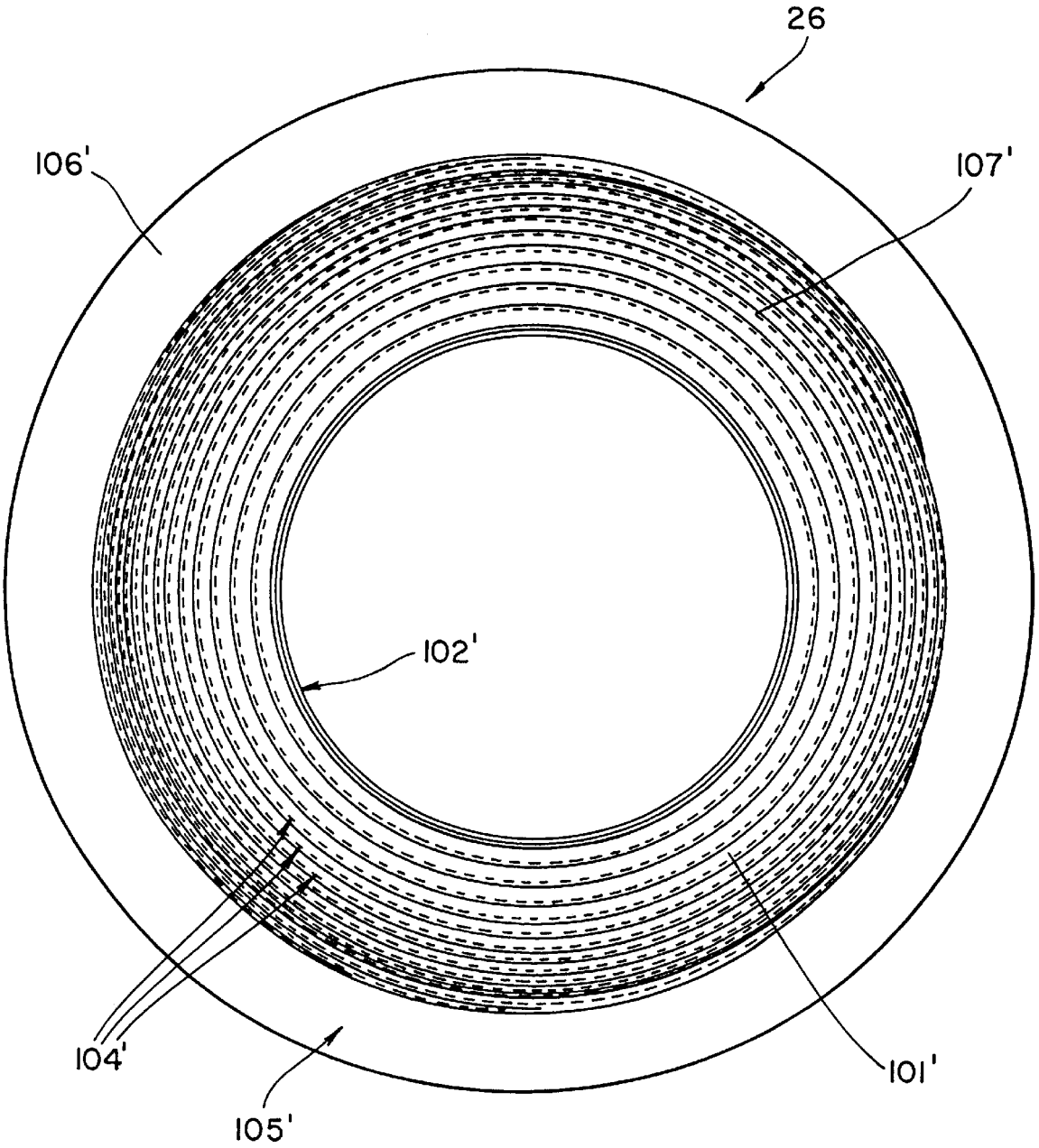
FIG. 11 is a top auxiliary view of the reflector with baffles illustrated in FIG. 7–10 as seen along the center line of the upper opening of the reflector.
Figure 12:
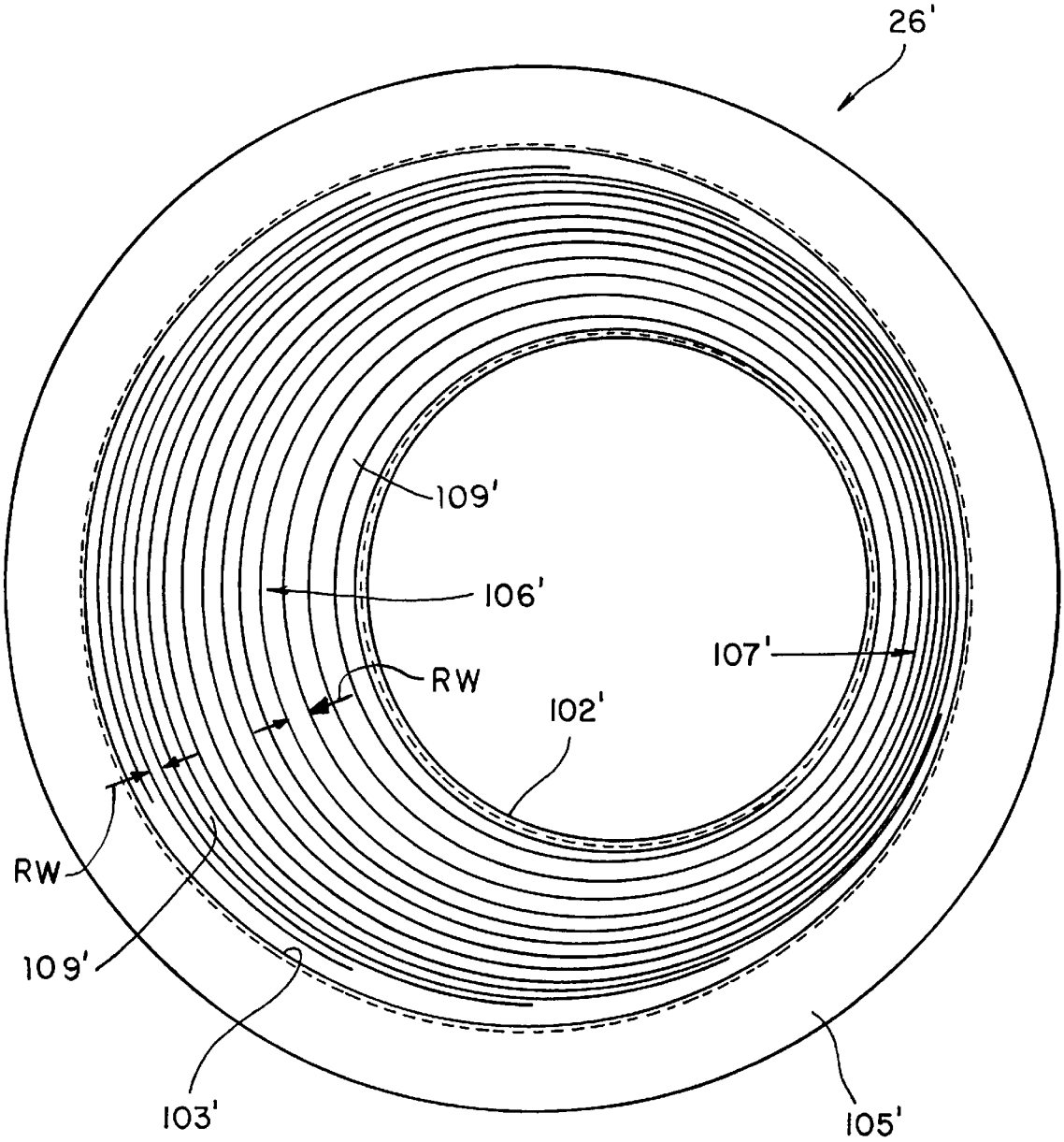
FIG. 12 is a bottom plan view of the reflector with baffles illustrated in FIGS. 7–11 as seen along the center line of the lower opening of the reflector.

As seen in FIGS. 2 and 6 second portion 92 also has a socket opening 96 with a pair of cutouts 98 for releasably receiving lamp socket 38 of lamp assembly 24 therein. More specifically, spring members 40 of socket 38 are received in cutouts 98 of socket opening 96 to releasably couple socket 38 to socket strap 52. Second portion 92 also includes a pair of stop members 100 which are located on the sides of bracket 50 to limit the amount of rotation or pivotable movement between socket strap 52 and bracket 50. More specifically, bracket 50 is positioned between stops 100 such that socket strap 52 has approximately 30° of rotation relative to bracket 50, i.e., 15° of rotation in both directions from its center position which in second portion 92 lies in a plane perpendicular to the plane of bracket 50.

Reflector 26 is preferably an asymmetrical cone-shaped reflector having a cone-shaped side wall 101 with an open upper end 102 and an open lower end 103. Preferably, side wall 101 has an annular flange 105 extending outwardly from lower end 103.

Due to the heat generated by lamp 39, reflector 26 is preferably constructed of a metallic material. In particular, reflector 26 is constructed as an integral, one-piece unitary member from a sheet material by hydroforming.

Baffled Reflector 26'

Referring now to FIGS. 7–12, reflector 26' is preferably a cone-shaped reflector having a cone-shaped side wall 101' with an open upper end 102' and an open lower end 103'. Preferably, side wall 101' has a plurality of annular, step-shaped baffles 104' and annular flange 105' extending outwardly from lower end 103'.

In its preferred form, reflector 26' is part of a truncated cone, as seen in broken lines in FIG. 7, having a center line $C_1$ with open upper end 102' and open lower end 103 lying in transverse planes $P_1$ and $P_2$, respectively. The planes $P_1$ and $P_2$ of open ends 102' and 103' are non-parallel planes which converge towards each other. Thus, side wall has a large side portion 106', where planes $P_1$ and $P_2$ diverge, and a small side portion 107', where planes $P_1$ and $P_2$ converge.

Open end 102' has its center lying on center line $C_1$, while open end 103' has its center lying on center line $C_2$. Center line $C_1$ extends perpendicular to plane $P_1$ and forms a 80° angle with plane $P_2$. Moreover, center line $C_1$ of the cone forming side wall 101' intersects center line $C_2$ at a 10° angle. Thus, center lines $C_1$ and $C_2$ are not colinear with respect to each other.

As seen in FIG. 8, each baffle 104' is formed by a first tubular section 108' and a second ring-shaped section 109' extending radially from tubular section 108'. Each tubular section 108' of the baffles 104' forms an elliptical tube, while each ring-shaped section 109' of baffles 104' forms an elliptical ring extending substantially perpendicular to its corresponding tubular section 108'. Generally speaking, baffles 104' form approximately a 10° angle to open lower end 103' and substantially perpendicular to center line $C_1$ of open upper end 102'.

Tubular sections 108' of baffles 104' are preferably equal in height, such as 0.25 inches. Ring-shaped section 109', on the other hand, has a radial width RW, Radial widths RW decrease in size from upper end 102' to lower end 103'. This arrangement of baffles 104' causes an optical illusion to provide a congruence of looks regardless of the slope of the ceiling.

More specifically, baffles 104' are nearly perfect circles, when viewed along center line $C_1$ of upper opening 102' and become slightly elliptical as viewed at other angles. The centers of baffles 104' are all substantially located on center line $C_1$.

Due to the heat generated by lamp 39, reflector 26' is preferably constructed of a metallic material. In particular, reflector 26' is constructed as an integral, one-piece unitary member from a sheet material by hydroforming.

Installation of Lighting Fixture 10

Lighting fixture 10 is installed in a ceiling preferably by first determining roughly the slope of the ceiling, and then initially setting the adjustable socket assembly 22 for that particular ceiling slope. More specifically, first fastener 62 is loosened for pivoting bracket 50 about the longitudinal axis of first fastener 62 to set the desired position. The installer can use the indicia or markings on label 86 to assist the installer in determining the correct position of bracket 50 relative to housing 12 for that particular ceiling slope. Once the installer has the bracket 50 at the correct angle, the installer will then tighten fastener 62 to secure bracket 50 in the desired position. This provides a rough adjustment of adjustable socket assembly 22 for holding lamp 44 at the desired angle for a particular sloped ceiling.

Now, the installer will mount housing 12 between support members or joists 18 via hangers 16 in a conventional manner. The installer now can run an electrical power line to junction box 20 to provide electrical power to lamp socket 38. Once electrical box 20 is wired to the power line of the building or installation, the ceiling material is applied over joists 18.

Next, reflector 26 is installed into trim collar 28 of housing 12 by suitable fastening means such as an adhesive. Now, the installer can move socket strap 52 linearly along the longitudinal axis of bracket 50 and/or rotationally about the longitudinal axis of fastener 70. Finally, the installer can thread lamp 44 into socket 38 to complete the installation. Of course, additional fine adjustments can be made by moving lamp 44.

Alternate Adjustable Socket Assembly 122

Figure 13:
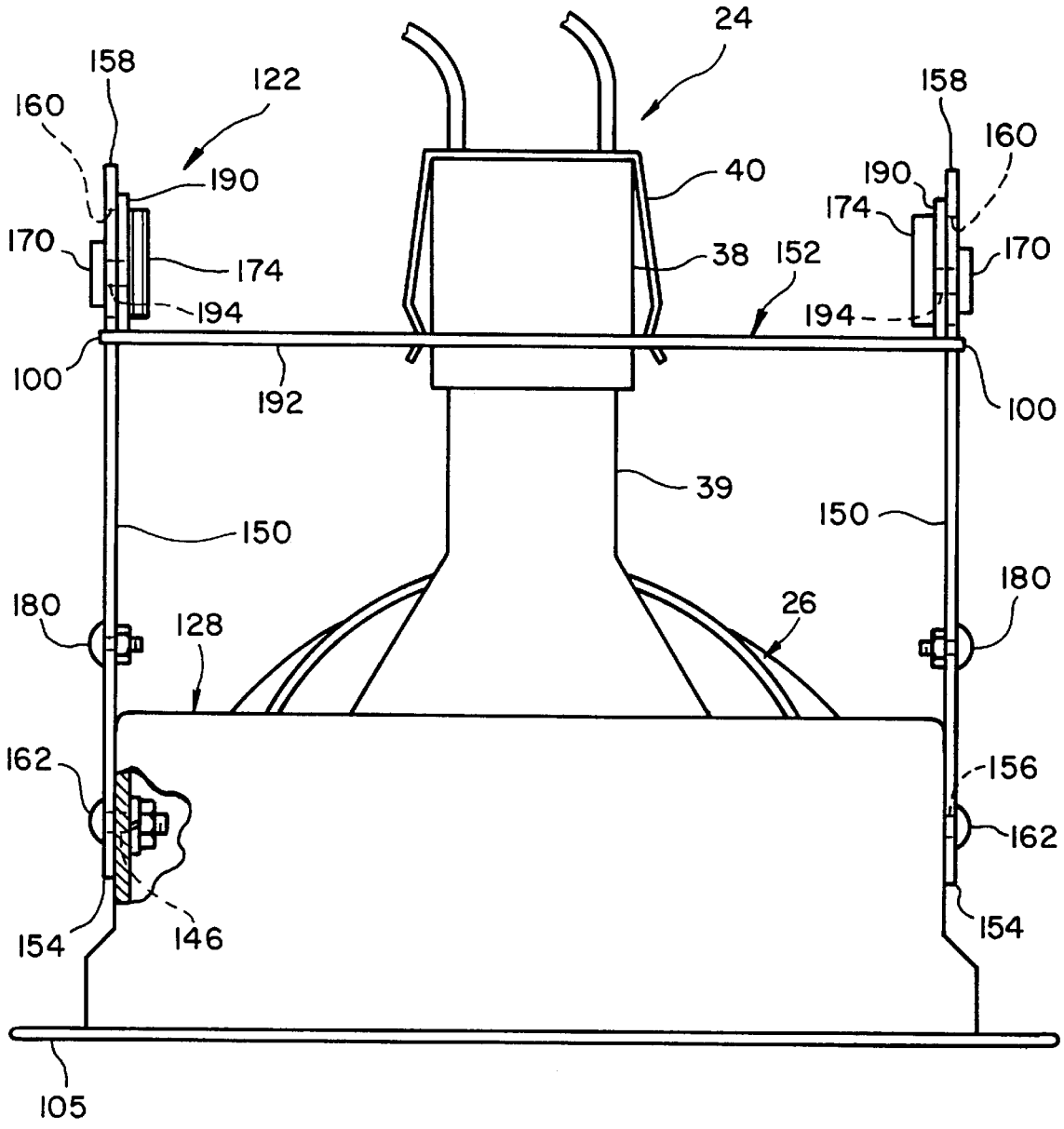
FIG. 13 is an end elevational view of an alternative embodiment of an adjustable socket assembly in accordance with the present invention.

Referring now to FIG. 13, a second embodiment of the present invention is illustrated. Namely, an adjustable socket assembly 122 is illustrated as being attached to a modified trim collar 128. Adjustable socket assembly 122 and trim collar 128 are designed to be used with housing 12, lamp assembly 24 and reflector 26 in substantially the same way as adjustable socket assembly 22 and trim collar 28 discussed above. Moreover, adjustable socket assembly 122 and trim collar 128 are similar in construction to adjustable socket assembly 22 and trim collar 28 discussed above. Thus, adjustable socket assembly 122 and trim collar 128 will not be discussed or illustrated in detail herein.

Trim collar 128 is preferably a tubular member having a substantially cylindrical or elliptical cross section, with an bottom open end 143 for fixedly receiving reflector 26 therein, and a top open end 144 for receiving lamp 39 therethrough. A pair of flat pivot sections 145 are formed on trim collar 128. A pivot hole 146 is provided on each flat section 145 of the side wall of trim collar 128 for pivotally coupling adjustable lamp assembly 122 thereto.

Adjustable socket assembly 122 includes an upstanding pair of brackets 150 and a U-shaped socket strap 152. Brackets 150 and socket strap 152 are preferably constructed of a sheet metal material which is stamped and/or bent to form brackets 150 and socket strap 152. For example, bracket 150 and socket strap 152 can be constructed of galvanized steel or any other suitable sheet metal material.

Brackets 150 are elongated flat members, which have a first end 154 with a first aperture 156 and a second end 158 with a second aperture 160. Apertures 156 are preferably circular holes which receive first fasteners 162 for pivotally coupling first ends 154 of brackets 150 to trim collar 128. More specifically, first fasteners 162 extend through apertures 56 of brackets 150 and pivot holes 146 of trim collar 128 to pivotally couple bracket 150 for limited rotational movement about the longitudinal axes of fasteners 162. First fasteners 162 together with pivot holes 146 of trim collar 128 and apertures 156 of bracket 150 form first pivot joints between adjustable socket assembly 122 and housing 12 for aiming lamp 39.

Second apertures 160 of brackets 150 are preferably elongated slots which receive second fasteners 170 for pivotally coupling second ends 158 of brackets 150 to socket strap 152. Preferably, second apertures or slots 160 provides approximately 1.5 inches of vertical or longitudinal movement of socket strap 152 along the longitudinal axis of brackets 150. Second fasteners 170 forms second pivot joints between adjustable socket assembly 22 and housing 12 for aiming lamp 39 as well as adjusting the location of lamp 39 within reflector 26.

Preferably, second fasteners 170 each include a shoulder rivet 172 and a stainless steel spring 174 which pivotally and slidably secures second ends 158 of brackets 150 to socket strap 152 for easy adjustment without the need for tools. More specifically, second fasteners 170 extend through apertures 160 of brackets 150 for both rotational and linear movement within apertures 160. The force of springs 174 are designed such that socket strap 52 can be easily rotated and/or moved vertically relative to brackets 50 to permit relative angular and linear adjustments therebetween without the need for tools, while maintaining lamp assembly 24 in any selected angular position once rotated or moved to a desired position.

Brackets 50 are also each preferably provided with a third threaded fastener 180, which forms a stop member for limiting the pivotal movement of brackets 150 relative to housing 12. Specifically, fasteners 180 are designed to engage the upper edge of trim collar 128 to limit the angular movement of brackets 150 relative to lamp housing 12. Preferably, fasteners 180 are designed to permit brackets 150 to pivot around the longitudinal axis of first fasteners 162 through an angle of approximately 90°. In other words, brackets 50 can pivot 45° in each direction from their vertical orientation, i.e., perpendicular to mounting frame 14.

A label can be applied to the center section of brackets 150 to aid the installer in the initial adjustment of lamp 39 for a particular sloped ceiling as mentioned above in the first embodiment.

Socket strap 152 has a pair of vertically extending planar portions 190 and a horizontally extending planar portion 192 extending substantially perpendicularly between vertical portions 190. Vertical portions 190 are each provided with an aperture or hole 194 for receiving second fastener 170 therein to pivotally and slidably couple socket strap 152 to brackets 150 about the longitudinal axis of second fasteners 170.

Second portion 192 also has a socket opening with a pair of cutouts for releasably receiving lamp socket 38 of lamp assembly 24 therein in substantially the same manner as discussed above in the description of the first embodiment. Second portion 192 also includes a pair of stop members 100 at each end, which are located on the sides of brackets 50 to limit the amount of rotation or pivotable movement between socket strap 152 and brackets 50. More specifically, brackets 150 are positioned between stops 100 such that socket strap 152 has approximately 30° of rotation relative to brackets 150, i.e., 15° of rotation in both directions from its center position which in second portion 192 lies in a plane perpendicular to the plane of brackets 150.

It will become apparent to those skilled in the art from this disclosure that various changes and modifications can be made herein without departing from the scope and spirit of the present invention as defined in the following claims.

What is claimed is:

1. A recessed lighting fixture for installation in a ceiling, comprising:

a housing with a mounting frame for attachment to a ceiling structure;

a reflector attached to said housing, said reflector having an open upper end and an open lower end;

an adjustable socket assembly movably coupled to said housing for three degrees of movement, said socket assembly including an upstanding bracket with first and second pivot joints and a socket strap, said bracket being pivotally coupled to said housing adjacent a first end of said bracket via said first pivot joint, and said socket strap being pivotally coupled to a second end of said bracket via said second pivot joint, said socket strap being movably coupled for linear movement relative to said housing; and a lamp socket coupled to said socket bracket for positioning a lamp within said reflector.

2. A recessed lighting fixture according to claim 1, wherein said first pivot joint includes a first aperture adjacent said first end of said bracket, and a first fastener positioned within said first aperture to pivotally couple said bracket to said housing.

3. A recessed lighting fixture according to claim 2, wherein said second pivot joint includes a second aperture adjacent said second end of said bracket, and a second fastener positioned within said second aperture to pivotally and slidably couple said socket strap to said bracket.

4. A recessed lighting fixture according to claim 3, wherein said second aperture is an elongated slot extending longitudinal along said bracket to permit said linear movement of said socket strap along said bracket.

5. A recessed lighting fixture according to claim 4, wherein said first fastener is a threaded fastener with a nut.

6. A recessed lighting fixture according to claim 5, wherein said second fastener includes a spring for overridably holding said bracket and said socket strap together in a selected position.

7. A recessed lighting fixture according to claim 6, wherein said housing includes a trim collar with said reflector mounted therein, and said first fastener coupled thereto.

8. A recessed lighting fixture according to claim 7, wherein said socket strap includes a first portion having a third aperture therein with said second fastener positioned within said third aperture, and a second portion extending at angle to said first portion with said lamp socket attached thereto.

9. A recessed lighting fixture according to claim 1, wherein said bracket includes indicia positioned relative to said housing so that rotation of said bracket causes said indicia to align with a part of said housing to indicate a preferred angle of said bracket for a particular slope of a ceiling.

10. A recessed lighting fixture according to claim 9, wherein said part of said housing is an upper edge of a trim collar with said reflector mounted therein.

11. A recessed lighting fixture according to claim 1, wherein said reflector includes a plurality of annular baffles extending substantially parallel to each other.

12. A recessed lighting fixture according to claim 11, wherein said annular baffles are angled approximately 10° relative to said lower end of said reflector.

13. A recessed lighting fixture according to claim 12, wherein each of said annular baffles has tubular section and a ring-shaped section, with said tubular sections having the center concentric with said open upper end.

14. A recessed lighting fixture according to claim 13, wherein said upper end lies in a first plane and said lower end lies in a second plane, and said ring-shaped sections of said baffles have a surface with a radial width facing said second plane and said radial widths are larger at said upper end of said reflector and gradually reduce towards said lower end of said reflector.

15. A recessed lighting fixture according to claim 14, wherein said reflector is a one-piece, unitary member with said lower end of said reflector including an annular flange extending outwardly therefrom.

16. A recessed lighting fixture according to claim 14, wherein said open upper and lower ends of said reflector lie in non-parallel planes.

17. A recessed lighting fixture for installation in a ceiling comprising:

a housing with a mounting frame for attachment to a ceiling structure;

a reflector attached to said housing, said reflector having an open upper end and an open lower end;

an adjustable socket assembly movably coupled to said housing for three degrees of movement, said socket assembly including an upstanding bracket and a socket strap with first and second pivot joints, said bracket being pivotally coupled to said housing adjacent a first end of said bracket via said first pivot joint, and said socket strap being pivotally coupled to a second end of said bracket via said second pivot joint, said socket strap being movably coupled for linear movement relative to said housing; and a lamp socket coupled to said socket bracket for positioning a lamp within said reflector, said first pivot joint including a first aperture adjacent said first end of said bracket, and a first fastener positioned within said first aperture to pivotally couple said bracket to said housing, said second pivot joint including a second aperture adjacent said second end of said bracket, and a second fastener positioned within said second aperture to pivotally and slidably couple said socket strap to said bracket, said second aperture being an elongated slot extending longitudinal along said bracket to permit said linear movement of said socket strap along said bracket, said first fastener being a threaded fastener with a nut, said second fastener including a spring for overridably holding said bracket and said socket strap together in a selected position, said housing including a trim collar with said reflector mounted therein, and said first fastener coupled thereto, said socket strap including a first portion having a third aperture therein with said second fastener positioned within said third aperture, and a second portion extending at an angle to said first portion with said lamp socket attached thereto, said socket strap further including a pair of stops with said bracket positioned therebetween to limit relative pivotal movement between said socket strap and said bracket by said second pivot joint.

18. A recessed lighting fixture according to claim 17, wherein said lamp socket is removably coupled within an opening formed in said second portion of said socket strap via a snap-fit.

19. A recessed lighting fixture according to claim 18, wherein said opening in said socket strap is a substantially circular opening with a pair of notches which receive spring member of said lamp socket.

20. An adjustable socket assembly for attachment to a housing of a recessed lighting fixture, comprising:

an upstanding bracket having a first end with a first aperture, and a second end with a second aperture;

a socket strap having a third aperture for coupling said bracket thereto, and an opening for coupling a lamp socket thereto;

a first fastener positioned in said first aperture of said bracket to form a first pivot joint for pivotally coupling said first end of said bracket to the housing of the recessed lighting fixture; and a second fastener positioned in said second aperture of said bracket and said third aperture of said socket strap to form a second pivot joint to pivotally couple said second end of said bracket to said socket strap, one of said apertures being an elongated slot to adjust the distance between first and second pivot joints.

21. An adjustable socket assembly according to claim 20, wherein said first fastener is a threaded fastener with a nut.

22. An adjustable socket assembly according to claim 21, wherein said second fastener includes a spring for overridably holding said bracket and said socket strap together in a selected position.

23. An adjustable socket assembly according to claim 22, wherein said second aperture is a slot.

24. An adjustable socket assembly according to claim 22, wherein said bracket further includes a stop member extending outwardly therefrom for engaging a part of the lighting fixture to limit movement of said bracket.

25. An adjustable socket assembly for attachment to a housing of a recessed lighting fixture, comprising:

an upstanding bracket having a first end with a first aperture, and a second end with a second aperture;

a socket strap having a third aperture for coupling said bracket thereto, and an opening for coupling a lamp socket thereto;

a first fastener positioned in said first aperture of said bracket to form a first pivot joint for pivotally coupling said first end of said bracket to the housing of the recessed lighting fixture; and a second fastener positioned in said second aperture of said bracket and said third aperture of said socket strap to form a second pivot joint to pivotally couple said second end of said bracket to said socket strap, one of said apertures being an elongated slot to adjust the distance between first and second pivot joints, said first fastener being a threaded fastener with a nut, said second fastener including a spring for overridably holding said bracket and said socket strap together in a selected position, said bracket further including a stop member extending outwardly therefrom for engaging a part of the lighting fixture to limit movement of said bracket, said socket strap further including a pair of stops with said bracket positioned therebetween to limit relative pivotal movement between said socket strap and said bracket by said second pivot joint.

26. An adjustable socket assembly according to claim 25, wherein said bracket includes indicia positioned relative to said housing so that rotation of said bracket causes said indicia to align with a part of said housing to indicate a preferred angle of said bracket for a particular slope of a ceiling.

27. An adjustable socket assembly according to claim 25, wherein said lamp socket is removably coupled within an opening formed in said second portion of said socket strap via a snap-fit.

28. A reflector for a recessed lighting fixture, comprising:

an open upper end lying in a first plane;

an open lower end lying in a second plane which is non-parallel to said first plane; and a side wall extending between said open upper and lower ends, said side wall including a plurality of annular baffles being angled to said second plane of said open lower end, each of said baffles having a tubular section with a center line extending perpendicular to said first plane and an inwardly extending ring-shaped section having a surface with a radial width facing said second plane, each of said tubular sections being concentric, and said radial widths of said ring-shaped sections being larger at said upper end and gradually smaller as they approach said lower end.

29. A reflector according to claim 28, wherein said reflector is a one-piece, unitary member with said lower end of said reflector including an annular flange extending outwardly therefrom.

* * * * *